United States Patent [19]

Jagen

[11] Patent Number: 4,603,936

[45] Date of Patent: Aug. 5, 1986

[54] ELECTRICAL CONNECTOR FOR A SHIELDED CABLE

[75] Inventor: Paul R. Jagen, Mechanicsburg, Pa.

[73] Assignee: E. I. Du Pont de Nemours and Company, Wilmington, Del.

[21] Appl. No.: 562,967

[22] Filed: Dec. 19, 1983

[51] Int. Cl.[4] ..... H01R 13/648; H01R 13/652

[52] U.S. Cl. ..... 339/143 R; 339/14 R

[58] Field of Search .... 339/143 R, 176 MP, 176 MF, 339/182, 183, 101, 14 R

[56] References Cited

U.S. PATENT DOCUMENTS

| | | | |
|---|---|---|---|
| 4,255,007 | 3/1981 | Michaels et al. | 339/101 X |
| 4,337,989 | 6/1982 | Asick et al. | 339/143 R |
| 4,449,778 | 5/1984 | Lane | 339/143 R |
| 4,457,575 | 7/1984 | Davis et al. | 339/143 R |
| 4,486,059 | 12/1984 | Deyoung | 339/14 R |
| 4,493,525 | 1/1985 | Hall et al. | 339/143 R |

*Primary Examiner*—Eugene F. Desmond

[57] ABSTRACT

A connector for a shielded cable includes a plug-like terminal matably receivable by a receptacle. A shielding member disposed within the plug-like terminal is electrically connected to the cable shield. A portion of the dielectric casing of the terminal is cut out to expose a portion of the shielding member. The receptacle carries a ground contact connection in a position registrable with the exposed portion of the shielding member so that when the plug-like terminal is inserted into the receptacle the exposed portion of the shielding member electrically contacts and engages the ground connection contact within the receptacle.

5 Claims, 7 Drawing Figures

ELECTRICAL CONNECTOR FOR A SHIELDED CABLE

BACKGROUND OF THE INVENTION

1. Field of the Invention

This invention relates to an electrical connector for interconnecting a shielded cable carrying an array of conductors to pin contacts disposed on the interior of a cabinet.

2. Description of the Prior Art

Recently promulgated regulations have established minimum magnitudes of electromagnetic interference (EMI) which may be emitted from consumer electronic equipment. One source of such EMI interference is data links used to interconnect a central processor and main memory of a computer with various peripheral input-/output devices, such as input keyboards and output printers. Shielded cables has been utilized to minimize or control the magnitude of the emissions produced on the data links by the rapid rise times of the digital pulses carried by the signal carrying conductors of the shielded cable. There is a need, however, to insure that the EMI shielding of the cable be further extended to that region where the shielded cable and the conductors therein are electrically interconnected to the circuitry disposed on the interior of the cabinet of the equipment.

Accordingly, it is believed advantageous to provide an electrical connector for use with a cable of the type having an array of conductors and a shield therein which electrically shields the conductor in the region in which the conductors make electrical contact to the circuitry on the interior of the cabinet of the equipment. Moreover, since the peripheral devices are, in typical use, expected to be connected and disconnected from the electronic circuitry in the cabinet numerous times over the useful life of the equipment, the connector must be adapted to be repeatedly interconnectable and yet insure that at each interconnection the shielding effect is provided to minimize EMI emissions.

SUMMARY OF THE INVENTION

A connector for a cable of the type having an array of conductors and a shield in accordance with the present invention includes a shielding member, preferably in the form of a rectangular can of conducting material, arranged to surround the array of conductors when the same are terminated within a suitable latch housing or the like. The shielding member is provided with a flange that is electrically connectable to the shield carried in the shielded cable. A dielectric casing surrounds the shielding member to form therewith a plug-like terminal. The casing has a cutout exposing the portion of the shielding member and carries a latch that is resiliently and pivotally mounted to the exterior thereof. A receptacle is disposed on the interior of the cabinet of the equipment with which interconnection by the cable is desired. An array of pin connectors is mounted in the receptacle. The receptacle includes a latch camming surface, an abutment surface, and a ground connection contact. The ground connection contact is disposed within the receptacle in a position registerable with the portion of the shielding member exposed by the cutout in the casing. Movement of the terminal into the receptacle causes the latch to engage the camming surface and to pivot with respect to the casing to facilitate introduction of the terminal into the receptacle. The latch, upon clearing the camming surface, resiliently snaps into latched engagement against the abutment surface to hold the terminal in the receptacle with the ground connection contact in electrical engagement with the shielding member and the pin connectors in engagement with the conductors in the housing.

BRIEF DESCRIPTION OF THE DRAWINGS

The invention may be more fully understood from the following detailed description thereof taken in connection with the accompanying drawings which form a part of this application and in which.

DETAILED DESCRIPTION OF THE INVENTION

Figures 1, 2:
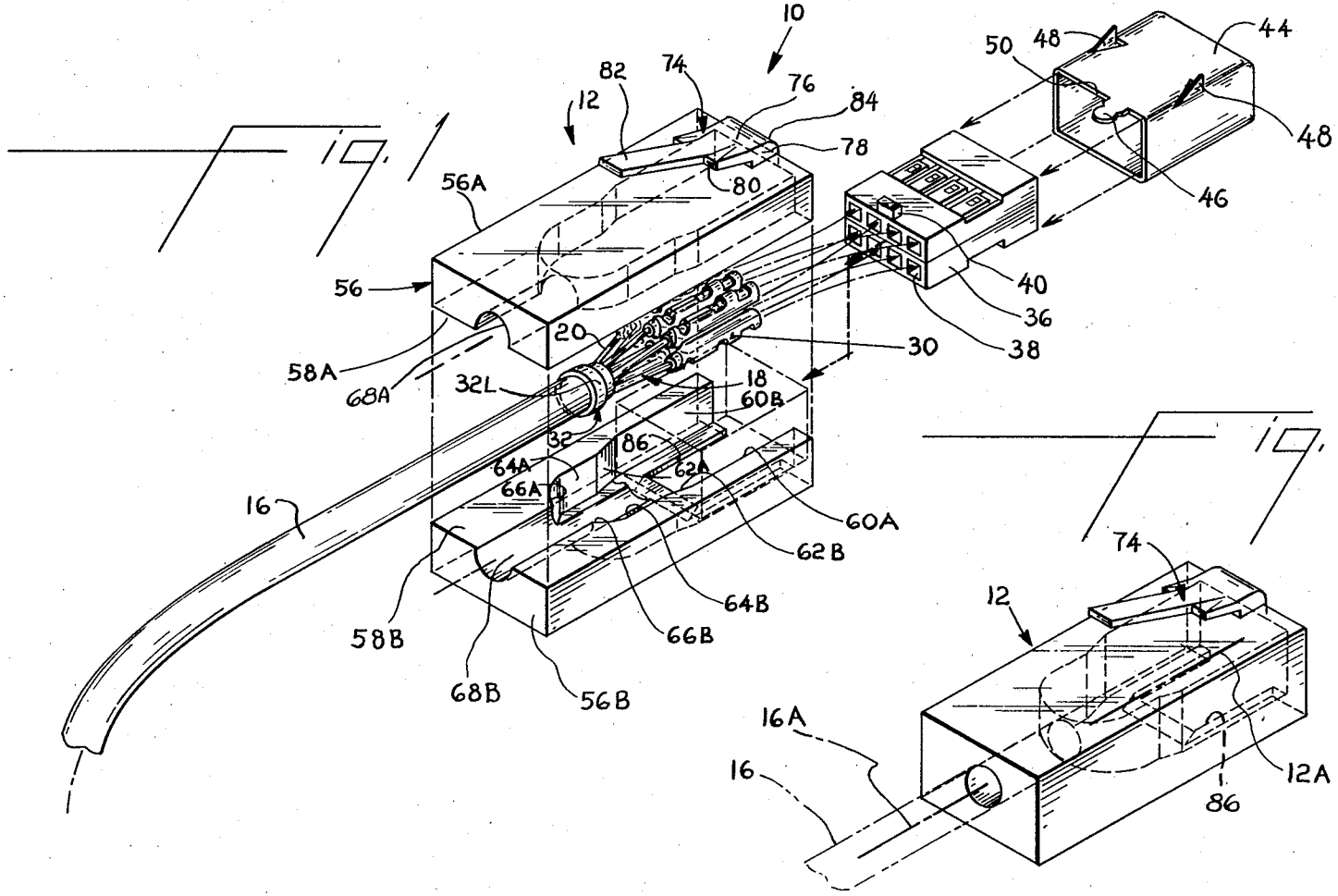
FIG. 1 is an exploded view of the elements of the plug-like terminal portion of the electrical connector in accordance with the present invention.
FIG. 2 is a perspective view of the plug-like terminal shown in FIG. 1 in its assembled configuration.

Throughout the following detailed description, similar reference numerals refer to similar elements in all Figures of the drawings.

The connector generally indicated by reference character 10 in accordance with the present invention includes a plug-like terminal 12 which is matably engagable with a receptacle 14 (shown in FIGS. 4 through 7). The connector 10 is adapted to electrically interconnect a shielded cable 16 of the type having a plurality of conductors 18 and a shield 20 therein with electrical circuitry (not shown) terminated by pin connectors 22 (FIGS. 4 through 7) disposed on the interior of the cabinet 24 of the electronic equipment with which interconnection is desired.

The cable 16 is standard shielded cable having an outer jacket of electrically nonconductive material which may be stripped away near one end thereof to expose the individual ones of the array of conductors 18 themselves sheathed by a suitable dielectric jacket. The shield 20, although shown as a single ground wire, may take the form of a braided sheath or drain, as appreciated by those skilled in the art. Each of the conductors 18 within the cable 16 is terminated by a suitable crimped termination 30, such as those sold by the DuPont Company, the assignee of the present application as Model No. 75691-005. As will be discussed, the exposed end of the sheath of the cable is provided with a band 32 that has an enlargement 32L thereon.

A terminal 12 includes a latch housing 36 formed of a suitable dielectric material in any convenient size. The housing 36 has an array of openings 38 therein designed to receive in a one-to-one relationship each of the conductors 18 through the crimped terminations 30 thereon. Although shown in the Figures as a two-by-four latch housing it is appreciated that the housing 36 may take any convenient configuration and remain within the contemplation of the present invention. Disposed on one surface of the housing 36 is a stop 40 useful for a purpose discussed herein.

A shielding member in the form of a substantially rectangular annular can 44 is formed of an electrically conductive material. The shielding member 44 is sized to slidably receive and to thereby surround the exterior of the latch housing 36. The shielding member 44 carries a projecting flange 46 thereon. Upstanding teeth 48 are conveniently provided in any suitable location about the periphery of the shielding member 44. The housing 36 is slidably received within the shielding member 44 until the tab 40 on the former abuts against the forward edge of the latter in the region indicated in the drawings by reference character 50.

Figure 6:
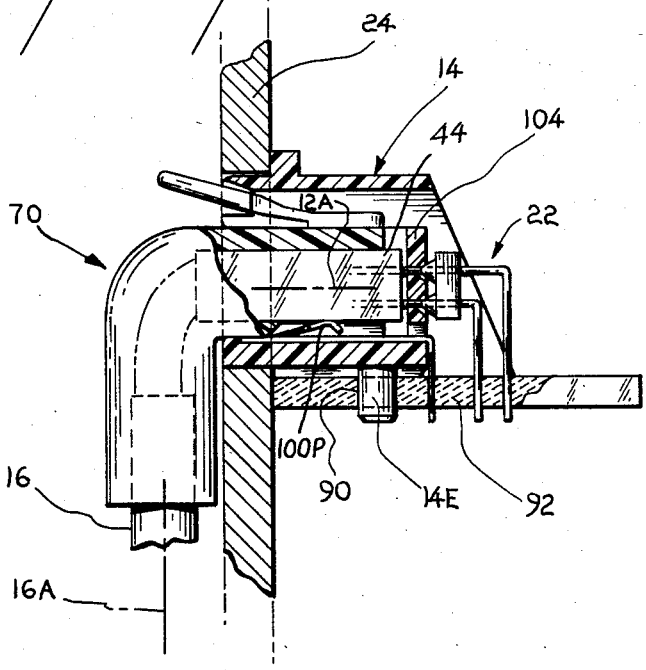
FIG. 6 is a side elevational of an alternate embodiment of the terminal.

The connector 10 further includes a dielectric casing 56 preferably integrally formed of a suitable material such as polycarbonate. In FIG. 1, the integral casing 56 is shown only for clarity of illustration in an exploded view which depicts the casing 56 as confronting upper and lower portions 56A and 56B, respectively. The interior of the casing 56 is relieved to define sidewalls 60A and 60B which form a rectangular recess sized to receive the shielded member 44 and mechanically support the exterior thereof. Communicating with each of the sidewalls 60 are guide surfaces 62A and 62B which join another set of confronting pairs of sidewalls 64A and 64B, respectively. The sidewalls 64 extend substantially parallel to the sidewalls 60. The ends of the sidewalls 64 taper through a converging pair of surfaces 66A and 66B, respectively into grooves 68A and 68B which define a cylindrical channel adapted to mechanically engage in snug relationship the exterior of the cable 16. In a modified embodiment of the invention shown in FIG. 6, the rearmost portion of the casing 56 is bent in a substantially right angle turn, as shown at 70, through the region carrying the cylindrical channel 68. Thus, as seen in the Figures, the axis 16A of the cable 16 may be substantially parallel to the axis 12A of the terminal 12 or, alternatively, as shown in FIG. 6 that axis 16A may extend substantially perpendicularly thereto.

One of the surfaces of the casing 56 carries a resiliently pivotable latch 74 having an enlargement 76 with generally parallel guide walls 78 thereon. The rear of the enlargement 76 defines abutment walls 80 from which depends an operating lever 82 of a narrower lateral dimension than that of the enlarged portion 76. The front end of the enlargement defines a stop surface 84. The other surface of the casing portion 56 is provided with a cutout for a purpose discussed herein.

To assemble the plug-like terminal 12 one end of the shielded cable 16 is inserted through the cylindrical channel 68 such that the end of the cable 16 projects through the open end of the casing 56 adjacent the sidewalls 60. The insulating jacket at the end of the shielded cable 16 is removed and the individual ones of the conductors 18 therein are exposed together with the shield 20. The conductors 18 the shield 20 are inserted through the band 32 and the band 32 advanced until the insulating jacket of the cable 16 is received within the enlargement 32L of the band 32.

Figure 3:
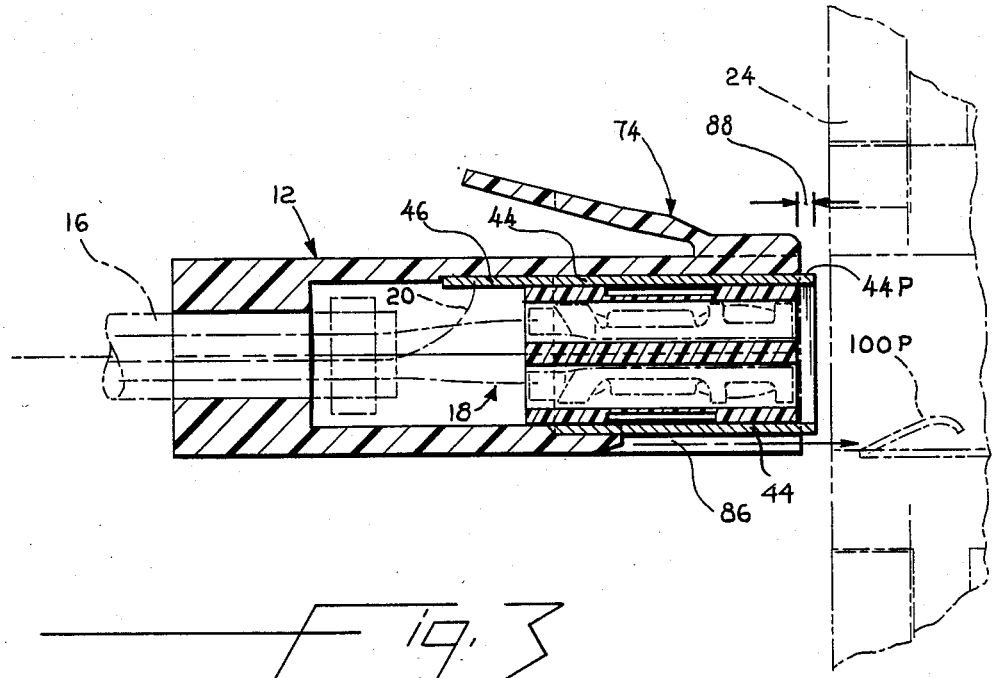
FIG. 3 is a side elevational view entirely in section of the plug-like terminal shown in FIGS. 1 and 2.
Figure 4:
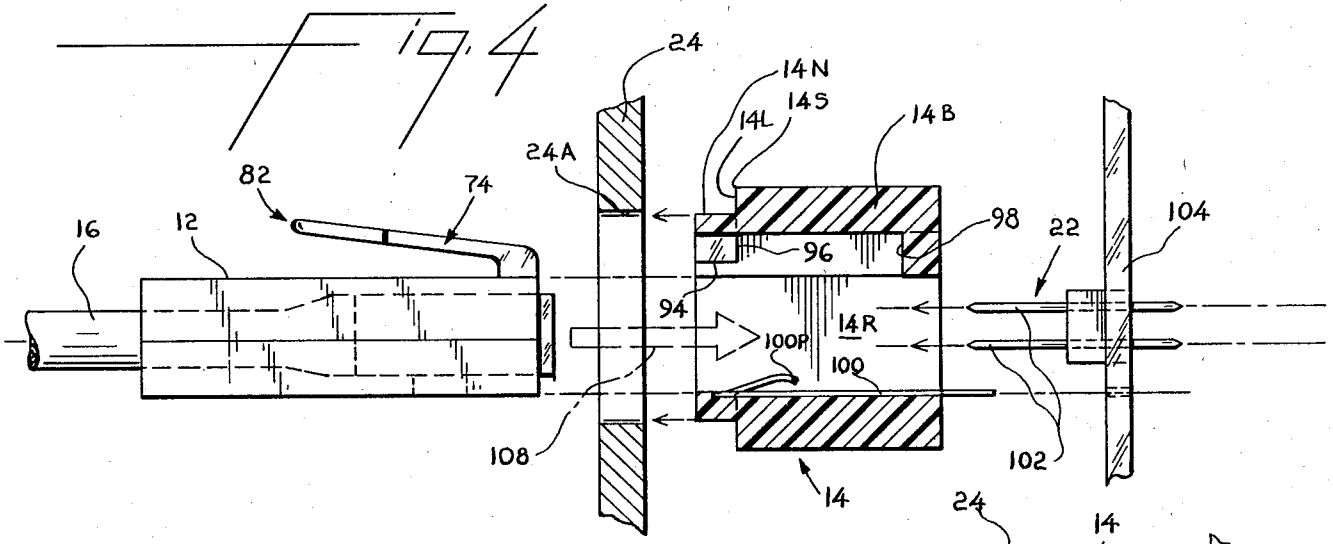
FIG. 4 is a side elevational view partially in section of a receptacle disposed on the interior of a cabinet which is connectable to the terminal of FIGS. 1 through 3.
Figure 5:
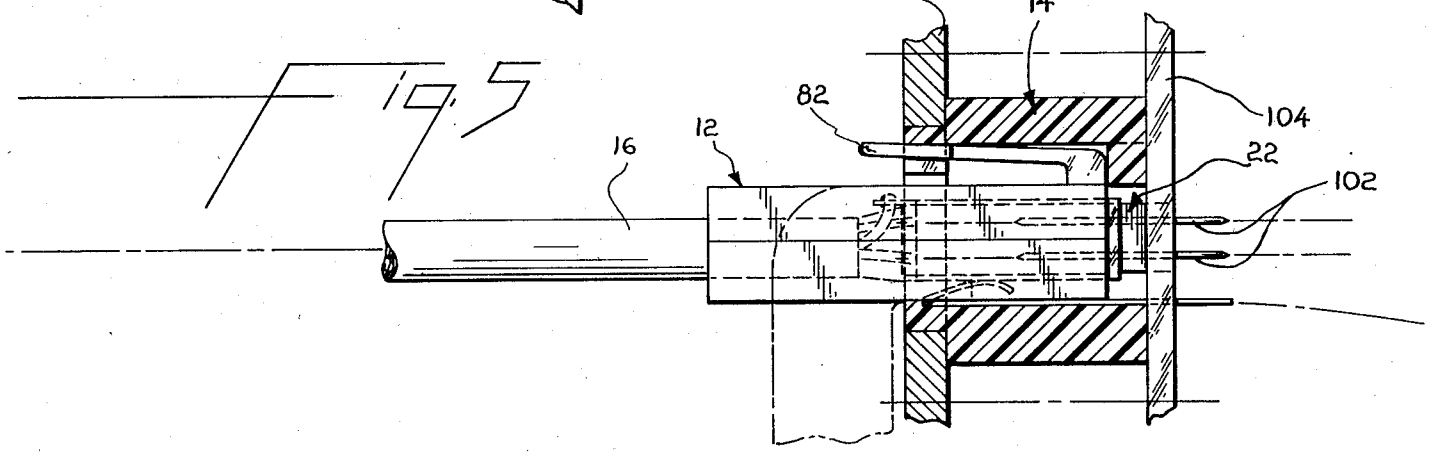
FIG. 5 is a side elevational view partially in section of the terminal and receptacle in the interconnected relationship.

The individual conductors 18 are crimped and suitably inserted into the terminals 30. The terminals 30 are inserted in a predetermined relationship into associated openings 38 in the housing 36. The shielding member 44 is slid over the latch housing 36 until the stop 40 on the housing 36 abuts against the shielding member 44 in the vicinity of the region 50 on the edge of the shielding member 44. The shield 20 is thereafter electrically connected, as by soldering, to the flange 46 on the shielding member 44. The dielectric casing 56 is thereafter advanced with respect to the cable 16 over the assembled relationship of the latch housing 36 and the shielding member 44. The inclined surfaces on the teeth 48 facilitate the advancement of the casing in the assembling direction but prevent removal thereof in an opposite direction. The end 56E of the casing 56 is set back a predetermined distance 88 (FIG. 3) to expose a peripheral portion 44P of the shielding member 44.

Advancement of the casing 56 with respect to the cable 16 draws the band 32 through the regions defined by the tapering walls 62, the sidewalls 64 and the throat defined by the surfaces 66 to thereby securely clamp the band 32, the exposed portions of the conductors 18 and the drain 20, and the engaged housing 36 and shielding member 44, respectively into those regions defined by the throat 66, the sidewalls 64, and the sidewalls 60. The assembled plug-like terminal 12 is then in a condition ready for insertion into the cooperating receptacle 14.

Figure 7:
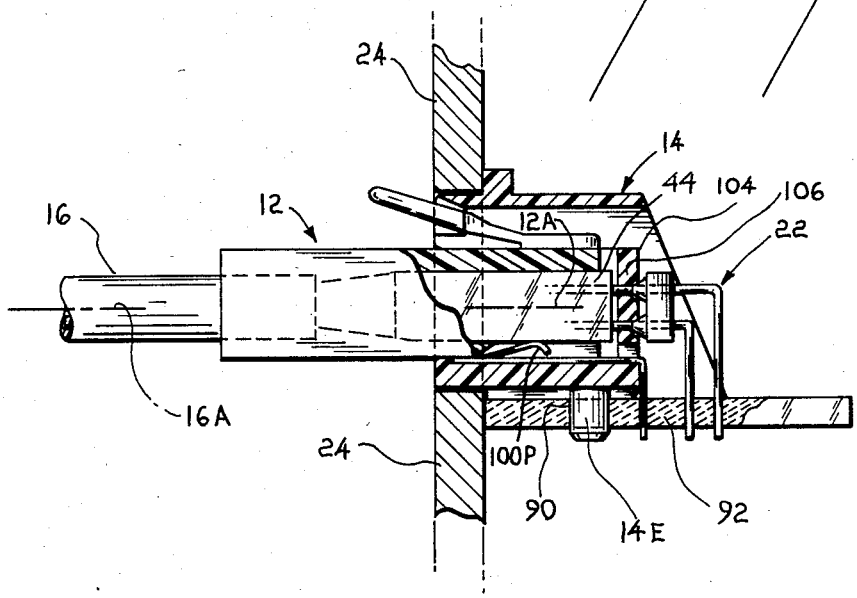
FIG. 7 is a side elevation view of an alternate embodiment of the receptacle.

As best shown in FIGS. 4 through 7, the receptacle 14 is a substantially hollow, open ended member that includes a main body portion 14B that defines a shell which encloses an interior recess 14R. The body 14B is fabricated of any suitable dielectric material, such as polycarbonate. The exterior of the body 14B narrows at a shoulder 14S to define a forwardly projecting neck 14N thereon. The neck 14N is sized to fit within an aperture 24A provided in the cabinet 24 of the electronic equipment. The shoulder 14S on the exterior of that body 14B serves as a limiting stop 14L to limit the advancement of the receptacle into the aperture 24A. In some embodiments, as shown in FIGS. 6 and 7, the undersurface of the receptacle 14 may include a downwardly projecting emboss 14E adapted to register with an opening 90 provided in a suitable support plate 92 secured on the interior of the casing or cabinet 24.

The interior of the body portion 14 is formed to define a camming surface 94, an abutment surface 96, and an interior stop 98.

Mounted within the recess 14R of the receptacle 14 in a position registerable with the portion of the shielding member 44 exposed by the cutout 86 is a ground connection contact 100. Preferably, the contact 100 includes a resilient prong 100P which projects into the volume of the recess 14R. An array of pin contacts 102, supported in any suitable manner from a support surface 104, projects into the recess 14R. Each of the pins 102 is adapted to interconnect in a one-to-one correspondence with the conductors 18 terminated in the housing 36. In the alternate embodiment of the invention shown in FIGS. 6 and 7, the support surface 104 takes the form of a support wall 106 which is mounted within the recess 14R. The wall 106 receives the pin contacts 102 and support the same. In this embodiment the interior stop 98 is omitted.

In operation advancement of the plug-like terminal 12 in the direction of the arrow 108 into the receptacle 14 causes the enlargement 76 of the latch 74 to be engaged by the camming surface 94. Continued insertion movement in the direction of the arrow 108 causes the latch 74 to pivot to facilitate the insertion of the plug-like terminal 12 into the receptacle 14, until the pin contacts 102 enter into the opposite openings in the housing 36 to electrically interconnect with the individual conductors 18. Advancement of the plug-like terminal 12 into the receptacle 14 is limited by the abutment of the stop surface 84 on the enlargement 76 with the interior stop 98 or by the engagement of the pin contacts 102 into the housing 36. Once the enlargement 76 of the latch 74 clears the camming surface 94, the latch 74 resiliently pivots in a counter direction to permit the locking surfaces 80 (FIG. 1) to engage against the abutment surfaces 96 to thereby hold the terminal 12 within the receptacle 14 with the ground connection contact 100 in wiping electrical engagement with the portion of the shielding member 44 exposed through the cutout 86 in the casing 56. The peripheral portion 44P of the shielding member 44 which projects from the edge of the casing 56 surrounds the interconnected pins and housing 36.

The outboard end of the operating lever 82 projects beyond the opening 24A in the cabinet 24 to facilitate the repeated insertion and removal of the plug-like terminal 12 into and from the receptacle 14.

In view of the foregoing, those skilled in the art may readily appreciate that herein has been provided an electrical connector for effectively terminating a shielded cable to prevent electromagnetic interference therefrom and yet to permit repeated insertions an removals of the same into and from a receptacle. Those skilled in the art, having benefit of the teachings of the present invention as hereinabove set forth, may effect numerous modifications thereto. These modifications are, however, to be construed as lying within the scope of the present invention as defined by the appended claims.

What is claimed is:

1. A connector for a cable of the type having a plurality of conductors and a shield comprising:

a dielectric housing with an array of openings for receiving the ends of each of the conductors;

a shielding member formed of electrically conductive material in the shape of a substantially rectangular annular can, said shielding member surrounding the dielectric housing and being electrically connectable to the shield of the cable;

a dielectric casing surrounding the shielding member to form a plug-like terminal of a substantially rectangular cross-section shape along a major portion of its length, the interior of the casing having a substantially rectangular recess for receiving said shielding member;

a resilient latch pivotally mounted to the exterior of the casing;

a cutout formed on one surface of the dielectric casing to expose a portion of one of the annular rectangular sides of the shielding member;

a receptacle having a substantially rectangular recess for receiving the terminal, said receptacle further including a latch camming surface and an abutment surface;

a ground connection contact mounted on an inner surface within the recess of the receptacle and projecting into the volume of said recess, said ground connection contact being in a position registrable with the cutout formed in the casing when the terminal is fully inserted into the receptacle;

movement of the terminal into the recess of the receptacle causing the latch to engage the camming surface and to pivot with respect to the terminal casing to facilitate introduction of the terminal into the receptacle, the latch upon clearing the camming surface resiliently snapping into latched engagement against the abutment surface of the receptacle to hold the terminal in a locked position within the receptacle recess, said locked position being the position where the ground connection contact is registrable with the cutout formed in the casing so that the ground connection contact is in electrical engagement with the portion of the shielding member exposed by said cutout whereby at said locked position the shielding member portion exposed by said cutout is located entirely within the recess of the receptacle and said electrical engagement is achieved completely within the recess of the receptacle.

2. The connector of claim 1 wherein the receptacle further includes a support surface within said recess, said support surface supporting an array of pin connectors projecting into said recess, said pin connectors being registrable with the array of openings in the dielectric housing of the terminal so as to interconnect in a one-to-one correspondence with the ends of conductors within the dielectric housing when the terminal is inserted into the receptacle.

3. The connector of claim 2 wherein the dielectric casing of the terminal is set back a predetermined distance from one end of the shielding member to expose a peripheral portion of said shielding member at the insertion end of the terminal, said exposed peripheral portion of the shielding member surrounding the interconnected pin connectors and conductors within the dielectric housing when the terminal is inserted into the receptacle.

4. The connector of claim 2 wherein the axis of the cable is substantially parallel to the axis of the terminal.

5. The connector of claim 2 wherein the axis of the cable is substantially perpendicular to the axis of the terminal.

* * * * *